US006698970B2

(12) United States Patent
Guillemet et al.

(10) Patent No.: US 6,698,970 B2
(45) Date of Patent: Mar. 2, 2004

(54) MULTIPOINT LOCKING MECHANISM FOR WINDOW SASH

(75) Inventors: Guy Guillemet, Terrebonne (CA); Daniel Varin, Brossard (CA); Marcel Van Der Hoeven, Burlington (CA)

(73) Assignee: Ferco Architectural Hardware, Laval (CA)

( * ) Notice: Subject to any disclaimer, the term of this patent is extended or adjusted under 35 U.S.C. 154(b) by 64 days.

(21) Appl. No.: 10/105,330

(22) Filed: Mar. 26, 2002

(65) Prior Publication Data

US 2003/0185623 A1 Oct. 2, 2003

(51) Int. Cl.[7] ..... E05C 9/02

(52) U.S. Cl. ..... 403/373; 403/322.1; 403/314.1; 292/161; 292/158; 292/340

(58) Field of Search ..... 292/340, 159, 292/158, 140, 139, DIG. 33; 403/373, 374.1–374.5, 353, 322.1, 322.2–322.4, 348

(56) References Cited

U.S. PATENT DOCUMENTS 4,991,886 A * 2/1991 Nolte et al. ..... 292/DIG. 33 X
5,829,802 A * 11/1998 Anderson et al. ..... 292/139 X
5,927,768 A * 7/1999 Dallmann et al. ..... 292/158
6,450,554 B1 * 9/2002 Rotondi et al. ..... 292/158

* cited by examiner

*Primary Examiner*—John R. Cottingham
(74) *Attorney, Agent, or Firm*—Ogilvy Renault; Guy J. Houle

(57) ABSTRACT

A multipoint locking mechanism for locking a window sash in a closed position in a window frame. The locking mechanism is of the type having a slider portion translating longitudinally in a window frame in response to an actuation of a handle to engage at least two engagement members of the slider portion with corresponding keeper portions in the window sash for locking the window sash to the window frame. At least one of the at least two engagement members is a cam wedge having at least one ramped portion and a rest portion. The cam wedge is positioned on the slider portion such that the at least one ramped portion abuts the corresponding keeper portion during a translation of the slider portion, and is guided by the corresponding keeper portion to abut the rest portion thereagainst to prevent a displacement of the window sash toward an open position thereof.

15 Claims, 7 Drawing Sheets

MULTIPOINT LOCKING MECHANISM FOR WINDOW SASH

TECHNICAL FIELD

The present invention generally relates to window assemblies and, more particularly, to mechanisms for multipoint locking of a window sash to a window frame.

BACKGROUND ART

Window sashes are mounted in window frames and the window sashes either slide, rotate or pivot in the window frame between fully open and closed positions, or any position therebetween. Various locking devices have been provided in order to lock window sashes to their respective window frames when the window sashes are in the closed position. Namely, U.S. Pat. No. 5,118,145, issued to Tucker on Jun. 2, 1992, U.S. Pat. No. 5,791,700, issued on Aug. 11, 1998 to Biro, U.S. Pat. No. 5,829,802, issued on Nov. 3, 1998 to Anderson et al., and No. 5,927,768, issued on Jul. 27, 1999 to Dallmann et al., each describe locking systems for window sash/window frame assemblies that qualify as being multipoint. Multipoint locking mechanisms for window sash comprise at least two pairs of interacting members that interact to lock the window sash to the window frame in at least two different points. Having multiple points of locking between a window sash and a window frame ensures a secure locking therebetween. A multipoint lock is also desirable as it prevents warping of the window sash and maintains it flush with the window frame and the weather stripping thereof to assure a good seal. If the sash is warped, the multipoint lock will exert a force on the sash to straighten it in the window frame. The points of lock allow the window sash to exert a uniform pressure on the window frame, and therefore a tight seal between the window frame and the window sash is maintained.

It is known to provide multipoint locking wherein the window lock has ramped keepers secured to the window sash and cam rollers on a slider bar which is mounted to the window frame. The slider bar translates up and down on a side wall of the window frame in response to manual or motorized actuation of a handle. By displacing the slider bar upward, the cam rollers on the slider bar, which may also be cams or mushroom cams, each engage a ramped portion of a respective ramped keeper so as to lock the window sash to the window frame. It is pointed out that the window sash must be generally closed for the rollers to engage the ramped keepers, yet the ramped portions of the ramped keepers ensure that the window sash will lock even when the window sash is not completely closed. When the window sash is locked, the rollers of the slider bar rest against a flat surface of the ramped keepers and prevent the opening of the window sash.

SUMMARY OF INVENTION

It is a feature of the present invention to provide an improved multipoint locking mechanism for window sashes and wherein the keeper and cam are both wedges that provide increased surface engagement and a greater displacement span.

According to the above feature of the present invention, and from a broad aspect thereof, the present invention provides a cam wedge for a locking mechanism for locking a window sash in a closed position in a window frame. The locking mechanism is of the type having a slider portion translating longitudinally on a window frame in response to an actuation of a handle to engage at least two engagement members of the slider portion with corresponding keeper portions secured on the window sash for locking the window sash to the window frame. The cam wedge comprises a body having at least one ramped portion and a rest portion. The cam wedge is secured to the slider portion to be one of the at least two engagement members such that the at least one ramped portion abuts a corresponding keeper portion during a translation of the slider portion, and is guided by the corresponding keeper portion to abut the rest portion thereagainst to prevent a displacement of the window sash toward an open position thereof.

In accordance with a further broad aspect of the present invention, there is provided a multipoint locking mechanism for locking a window sash in a closed position in a window frame. The locking mechanism is of the type having a slider portion translating longitudinally in a window frame in response to an actuation of a handle to engage at least two engagement members of the slider portion with corresponding keeper portions in the window sash for locking the window sash to the window frame. At least one of the at least two engagement members is a cam wedge having at least one ramped portion and a rest portion. The cam wedge is positioned on the slider portion such that the at least one ramped portion abuts the corresponding keeper portion during a translation of the slider portion, and is guided by the corresponding keeper portion to abut the rest portion thereagainst to prevent a displacement of the window sash toward an open position thereof.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
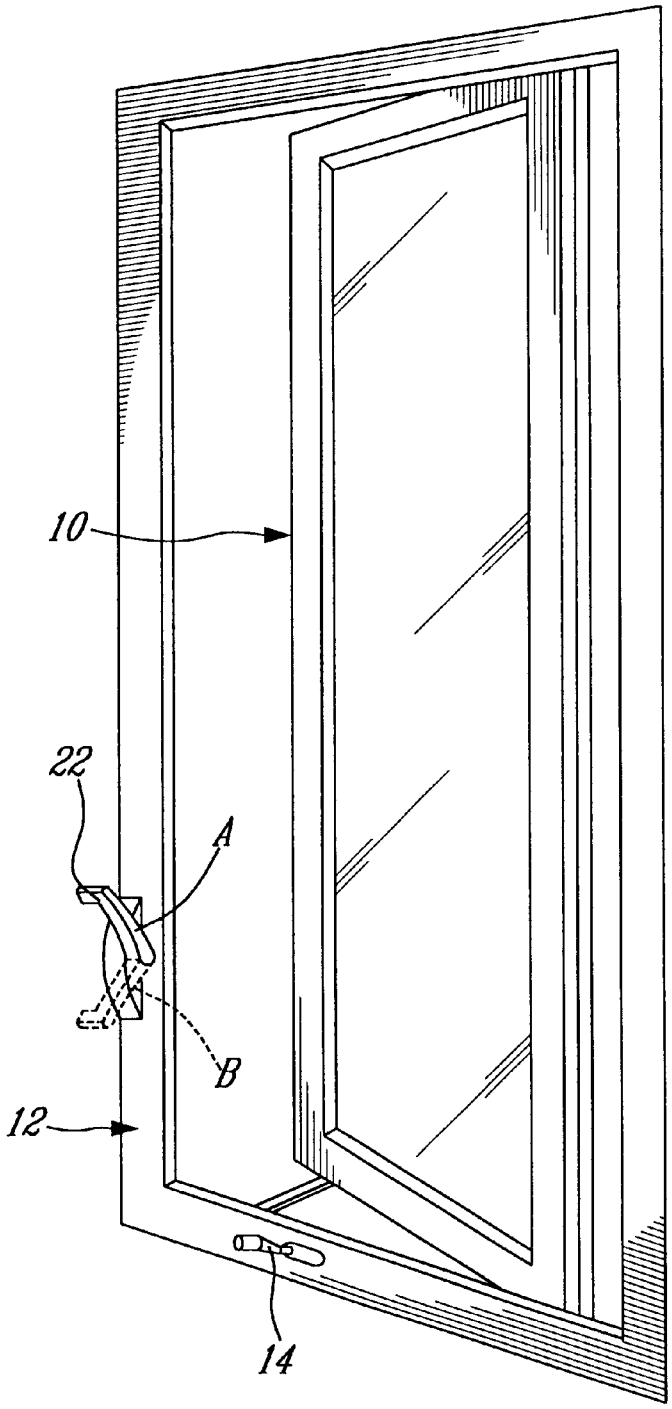
FIG. 1 is a perspective view of a window having a multipoint locking mechanism in accordance with the present invention.

Referring to the drawings and, more particularly, to FIG. 1, a window sash 10 is shown pivotally mounted to a window frame 12, with a handle 14 at a base of the window frame 12 rotatable for opening and closing the window sash 10. For simplicity purposes, the multipoint locking mechanism of the present invention will be referred to hereinafter as "the locking mechanism 20." The locking mechanism 20, not shown in FIG. 1, has a handle 22, pivotable between a locking position A and an unlocked position B, to lock/unlock the window sash 10 in the frame 12.

Figure 2:
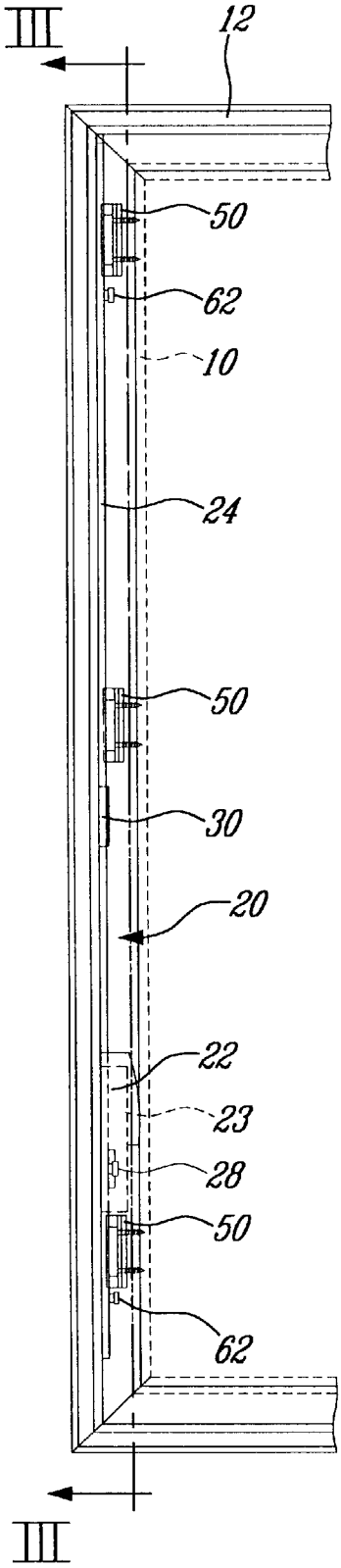
FIG. 2 is a front elevational view, partly fragmented, showing the multipoint locking mechanism secured between a window frame and sash and disposed at an unlocked position.
Figure 3:
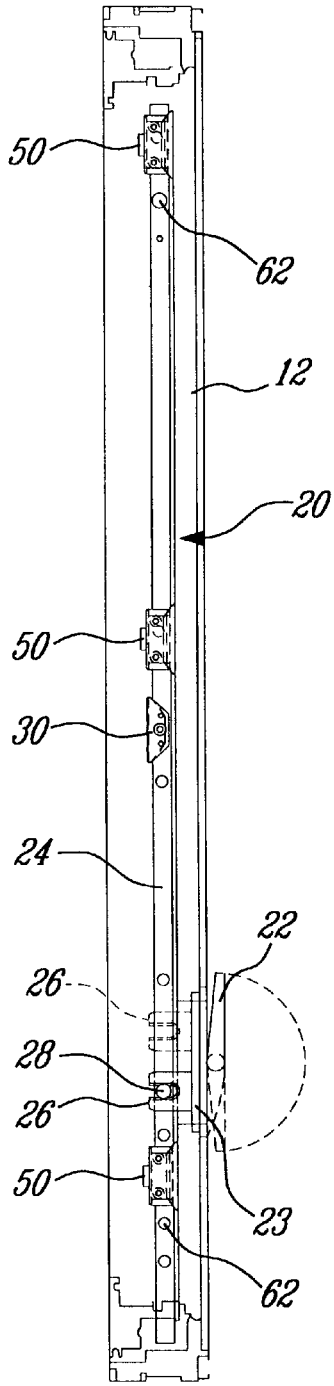
FIG. 3 is a cross-sectional view showing the multipoint locking mechanism and taken along cross-sectional lines III—III of FIG. 2.
Figure 4:
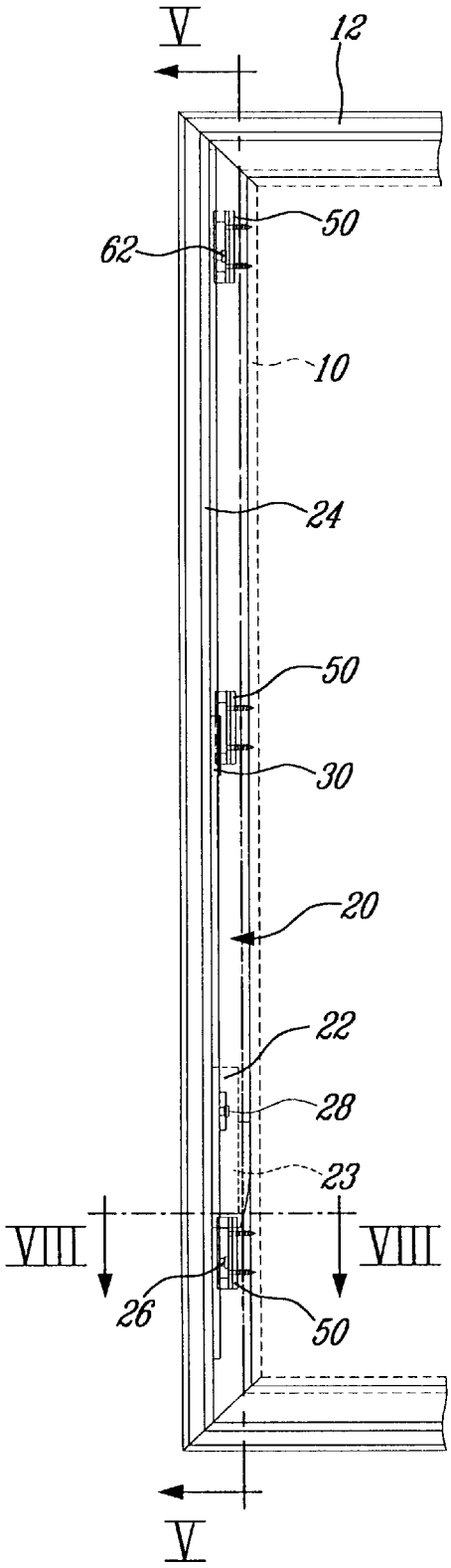
FIG. 4 is a front elevational view, partly fragmented, showing the multipoint locking mechanism in a locked position.
Figure 5:
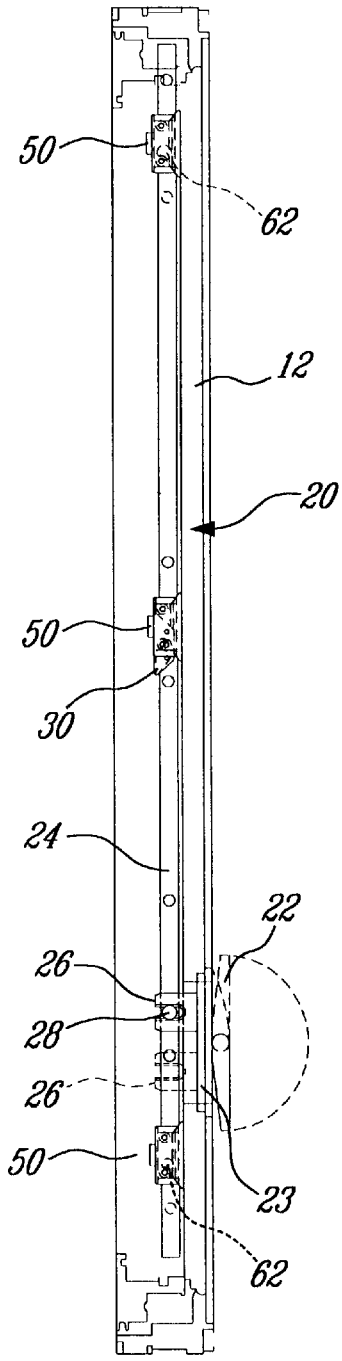
FIG. 5 is a cross-sectional view of the multipoint locking mechanism taken along cross-sectional line V—V of FIG. 4.
Figure 6A:
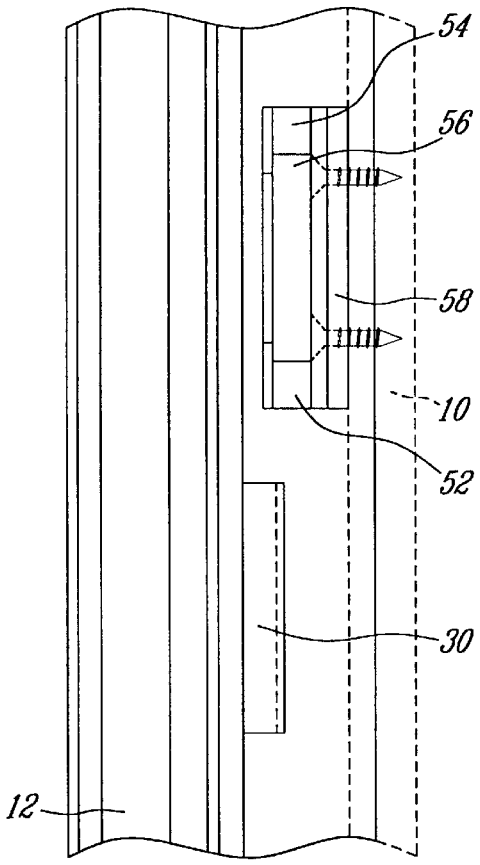
FIG. 6A is an enlarged front elevational view of a cam wedge and keeper wedge pair of the multipoint locking mechanism in the unlocked position.
Figure 6B:
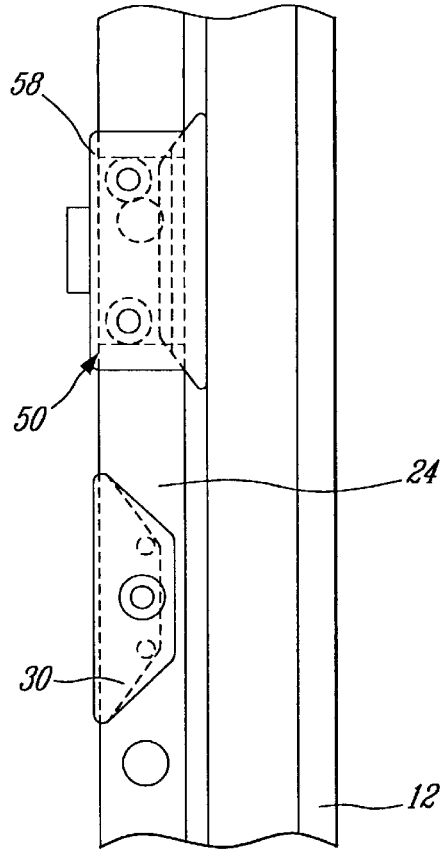
FIG. 6B is an enlarged perspective view of the cam wedge and keeper wedge pair of the multipoint locking mechanism in the unlocked position.

Referring now to FIGS. 2 and 3, the locking mechanism 20 is shown, and it has a slider bar 24 extending generally a predetermined length between a bottom and a top of the window frame 12. The slider bar 24 is a steel bar slidingly mounted to the window frame 12 so as to slide between an unlocked position, as illustrated in FIGS. 2 and 3, and a locking position, which will be described hereinafter and is illustrated in FIGS. 4 and 5. The slider bar 24 is displaceable between its unlocked position and its locking position by the actuation of the handle 22. Accordingly, the locking and unlocking positions of the slider bar 24 correspond to the locking and unlocking positions of the handle 22. The handle 22 has a fork 26 which is displaced by an actuating linkage 23. The fork 26 is coupled to a pin 28 secured to the slider bar 24 and actuates the displacement of the slider bar 24 between the unlocked position and the locking position.

Figure 9:
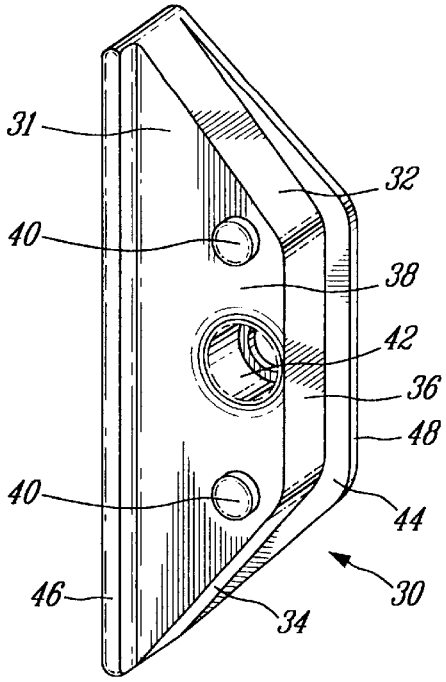
FIG. 9 is a perspective view of the cam wedge of the locking mechanism.

As shown in FIG. 3, the slider bar 24 has a cam wedge 30 in a middle portion thereof. Although the cam wedge 30 is illustrated in the middle portion of the slider bar 24, it may be at any position thereon, such as ¼, ⅓, ½ of the height, or any other specified position. As shown in FIG. 9, the cam wedge 30 has a trapezoid-shaped body 31 with ramped portions 32 and 34 and a flat rest portion 36. A slider bar contact surface 38 of the body 31 has a pair of protrusions 40 projecting outwardly therefrom. A through bore 42 is provided in the body 31 and extends therethrough from the slider bar contact surface 38 to an outer surface 44, with the portion of the through bore 42 emerging out of the outer surface 44 being countersunk. When the cam wedge 30 is secured to the slider bar 24, the protrusions 40 are received in corresponding holes in the slider bar 24 to arrest the cam wedge 30, and a fastener, such as a screw, a bolt, or a rivet, fastens the cam wedge 30 to the slider bar 24. As shown in FIG. 3, when the cam wedge 30 is secured to the slider bar 24, the ramped portions 32 and 34 and the flat rest portion 36 face toward the interior side of the window frame, i.e., the side of handle 22. A first lip 46 projects outwardly from the slider contact surface 38 and abuts a side edge surface of the slider bar 24 to ensure the stability of the connection between the cam wedge 30 and the slider bar 24. A second lip 48 extends outwardly from the ramped portions 32 and 34 and the flat rest portion 36. The use of the second lip 48 will be described hereinafter.

Figure 10:
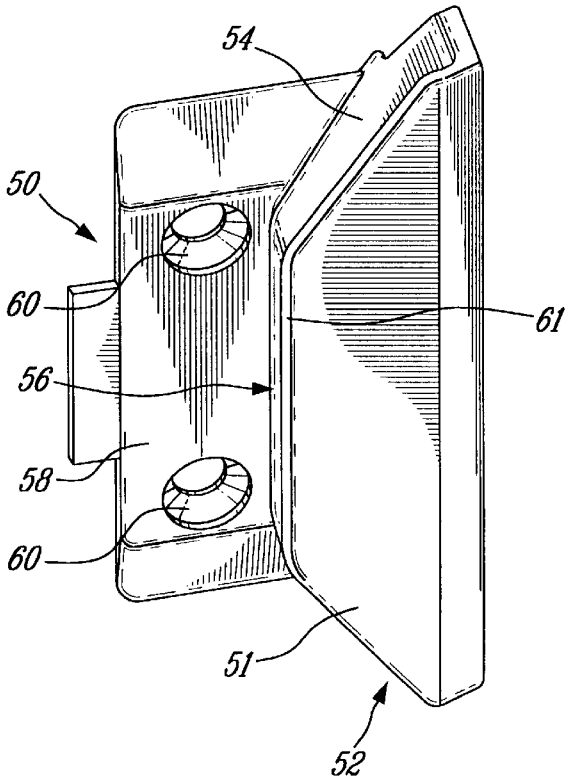
FIG. 10 is a perspective view of a keeper wedge of the locking mechanism.

Returning to FIGS. 2 and 3, the three keeper wedges 50 are shown secured to the window sash 10. Referring to FIG. 10, one of the keeper wedges 50 is shown in greater detail. The keeper wedge 50 has a trapezoid-shaped body 51. The body 51 has ramped portions 52 and 54 and a flat rest portion 56. A flange 58 extends outwardly from the ramped portions 52 and 54 and the flat rest portion 56, and has a pair of beveled through bores 60, so as to be secured by fasteners such as screws or bolts to the window sash 10. A lip 61 projects upwardly from the ramped portions 52 and 54 and the flat rest portion 56, and its use will be described hereinafter.

Referring to FIGS. 2 and 3, the slider bar 24 is shown in its unlocked position, with the window sash 10 in a generally closed position with respect to the window frame 12. The locking mechanism 20 illustrated in FIGS. 2 to 5 has one cam wedge 30 in a middle of the slider bar 24, and rollers 62, which may be mushroom cams, at top and bottom ends of the slider bar 24. When the slider bar 24 is in its unlocked position, the cam wedge 30 thereon is slightly below the middle keeper wedge 50. This is best seen in FIG. 7B. Similarly, the rollers 62 are also slightly below corresponding ones of the keeper wedges 50.

To lock the window sash 10 to the window frame 12, the handle 22 is gradually displaced from its unlocked position to its locked position. This will result in a gradual upward motion of the slider bar 24, such that the rollers 62 and the cam wedge 30 thereon will come into contact with the keeper wedges 50. More precisely, as shown in FIG. 7B, the ramped portion 32 of the cam wedge 30 will meet the ramped portion 52 of the middle keeper wedge 50, and one will slide on the other, thereby pulling the window sash 10 toward the window frame 12. Once the ramped portions 32 and 52 are past one another, the flat rest portions 36 and 56 will slide on one another until the slider bar 24 reaches its locking position, at which point the flat rest portions 36 and 56 will rest in abutment one against the other.

Similarly, the rollers 62 will end up resting against the flat rest portion 56 of the uppermost and lowermost keeper wedges 50. However, instead of having a ramped portion 32 sliding against a ramped portion 52 of the keeper wedge 50, the rollers 62 will roll or slide on the ramped portions 52 of the keeper wedges 50 until the rollers 62 are past the ramped portions 52, at which point they will roll on the flat rest portions 56 of the keeper wedges 50. When the slider bar 24 reaches its locking position, the rollers 62 will rest in abutment against the flat rest portions 56 of the keeper wedges 50.

Accordingly, the abutment between the keeper wedges 50 and the rollers 62 and the cam wedge 30 prevents the opening of the window sash 10, whereby the window sash 10 is said to be locked to the window frame 12. As best seen in FIG. 7B, the cam wedge 30 will be an obstacle that will prevent the keeper wedge 50 from moving in the direction of arrow A, i.e., from moving in an opening direction of the window sash 10. Although not illustrated, the rollers 62 also act as an obstacle to the opening of the window sash 10 by resting in abutment against the flat rest portions 56 of the keeper wedges 50.

Figure 7A:
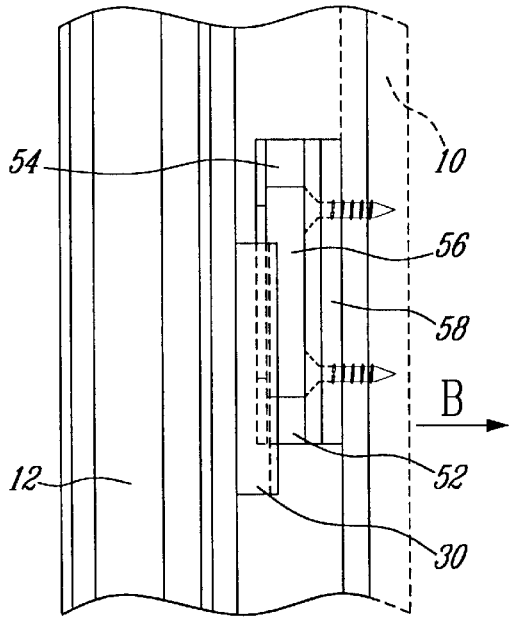
FIG. 7A is an enlarged front elevational view of the cam wedge and keeper wedge pair of the multipoint locking mechanism in the locked position.
Figure 7B:
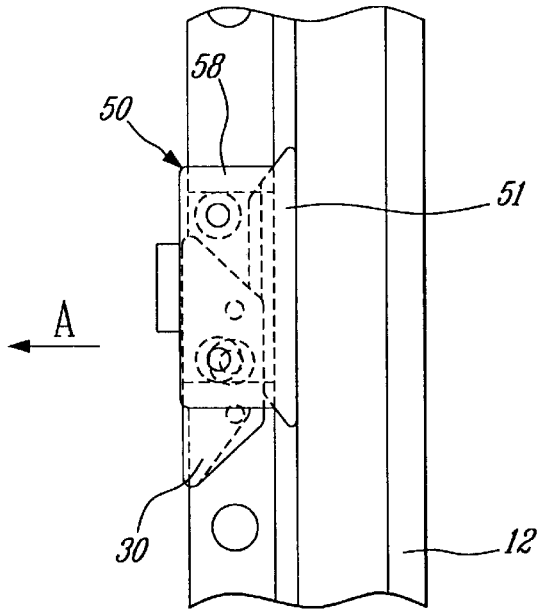
FIG. 7B is an enlarged perspective view of the cam wedge and keeper wedge pair of the multipoint locking mechanism in the locked position.

Furthermore, as best seen in FIG. 7A, the second lip 48 of the cam wedge 30 abuts against the lip 61 of the keeper wedge 50, such that the window sash 10 cannot be tampered with laterally, i.e., in the direction of arrow B, so as to surround the cam wedge 30 to open the window sash 10. Similarly, the rollers have mushroom heads that abut against the lips 61 of the keeper wedges 50.

It has been thought to position the cam wedge 30 and the rollers 62 on the slider bar 24 such that the cam wedge 30 initiates the locking of the window sash 10 to the window frame 12 as explained above, while the rollers 62 have yet to come in contact with their respective keeper wedges 50. More specifically, once the ramped portion 32 of the cam wedge 30 has met the ramped portion 52 of the middle keeper wedge 50 and has started sliding thereon, one of the rollers 62, such as the lower one, engages its corresponding keeper wedge 50, to finally be followed by the upper roller 62. Thus, this position of the cam wedge 30 and the rollers 62 creates a gradual step locking action of the window sash 10 to the window frame 12.

To unlock the window sash 10 from the window frame 12, the handle 22 is displaced from its locking position to its unlocked position. By doing so, the slider bar 24 is gradually displaced from its locking position (as shown in FIGS. 4 and 5) to its unlocked position (as shown in FIGS. 4 and 5), thereby moving the cam wedge 30 and the rollers 62 away from the keeper wedges 50. Accordingly, the cam wedge 30 and the rollers 62 are no longer obstacles that prevent the window sash 10 from being opened.

Although the locking mechanism 20 illustrated in FIGS. 2 to 5 has one cam wedge 30 for two rollers 62, it is obvious that the locking mechanism 20 may be provided with three cam wedges 30. The locking mechanism 20 is said to be "multipoint," as it has at least two points of contact between the window sash 10 and the window frame 12, namely the cam wedge 30 and the middle keeper wedge 50, and the rollers 62 and the end keeper wedges 50. Although the locking mechanism 20 illustrated in FIGS. 2 to 5 has three points of contact, two points of contact could also have been sufficient, and four or more points of contact could be used for higher windows. Also, the above described offsetting of the cam wedge 30 and the rollers 62 may also be performed on a locking mechanism 20 having only cam wedges 30. It is obvious that one can position the keeper wedges 50 on the window sash 10 to create the gradual step locking action.

The use of a cam wedge 30 interacting with a keeper wedge 50 provides a few advantages. Namely, the closing action created by the locking of the window sash 10 to the window frame 12 involves a greater displacement of the window sash 10 with respect to the window frame 12 when compared to a roller performing the locking, in the event where the roller has a diameter similar to the width of the cam wedge 30. In order for a roller to engage the ramped portion 52 of the keeper wedge 50, the ramped portion 52 of the keeper wedge 50 must come into contact with the roller at least in alignment with the center of the roller, otherwise there is no engagement between the roller and the keeper wedge 50. On the other hand, the ramped portion 32 of the cam wedge 30 needs only to have its tip come into contact with the tip of the ramped portion 52 of the keeper wedge 50 in order to engage therewith.

Figure 8:
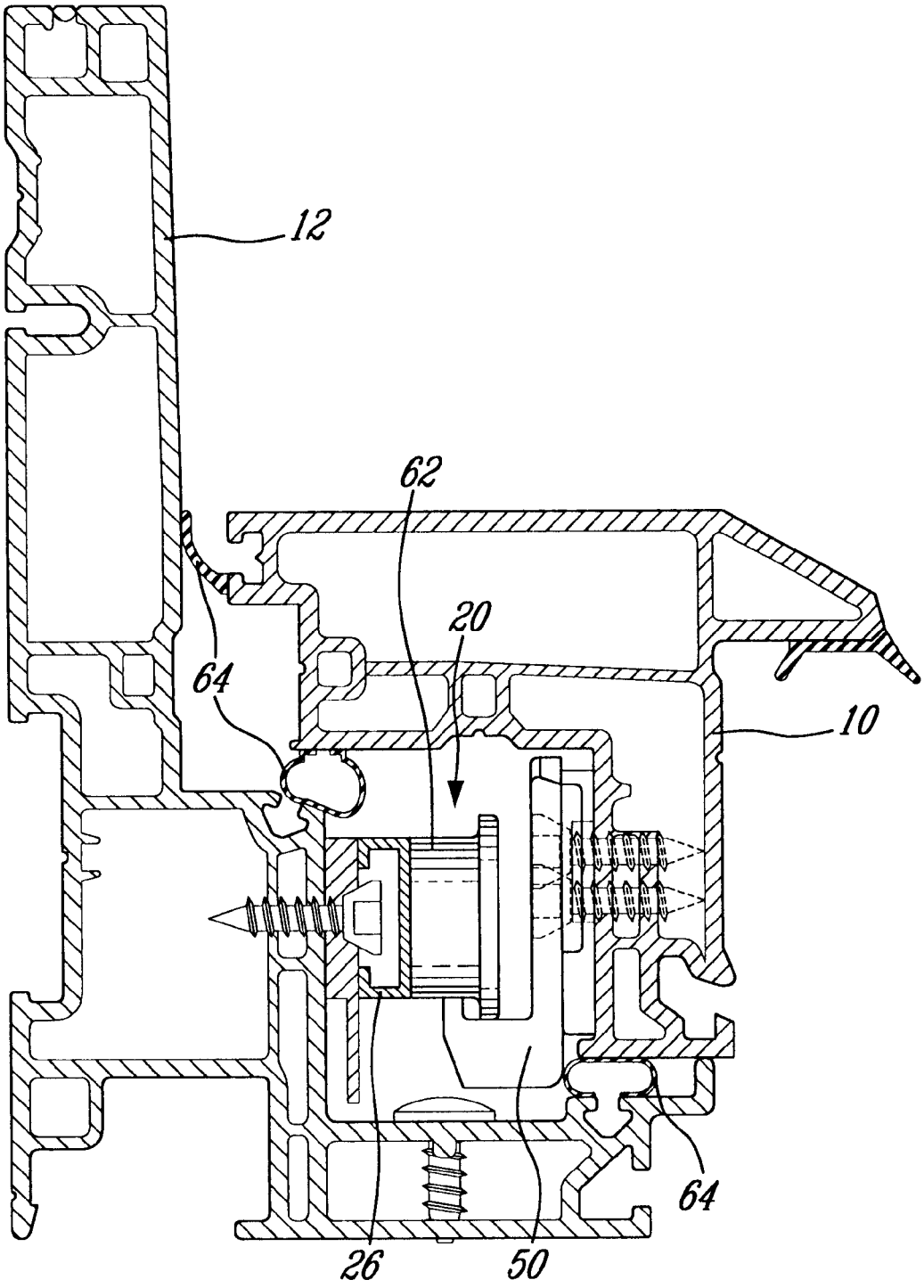
FIG. 8 is a cross-sectional view of the multipoint locking mechanism taken along cross-sectional line VIII—VIII of FIG. 4.

Referring to FIG. 8, the increased displacement in the closing action resulting from the locking of the window sash 10 to the window frame 12 enables a greater compression of resilient sealing means 64 located on the periphery of the window sash 10 and coming into contact with various portions of the window frame 12 to assure the sealing therebetween.

The cam wedge 30 is solidly secured to the slider bar 24 by its protrusions 40, its lip 46 and the fastener received in the through bore 42. In comparison, a roller has one connection point with the slider bar 24, i.e., its pivot. Therefore, pivots are more prone to break as a result of a force applied to the window sash than an engagement member, such as the cam wedge 30, that is secured to the slider bar 24 in at least two points.

Figure 11:
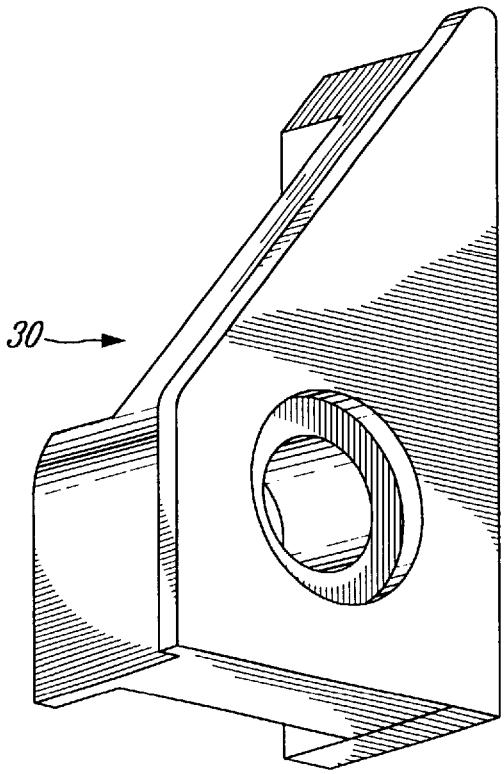
FIG. 11 is a perspective view of a cam wedge of the locking mechanism in accordance with another embodiment of the present invention.
Figure 12:
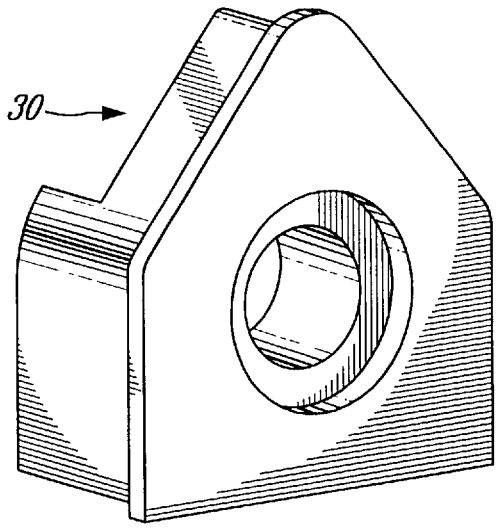
FIG. 12 is a perspective view of the cam wedge in accordance with another embodiment of the present invention.

The cam wedge 30 and the keeper wedges 50 are each shown having two ramped portions. Although only one ramped portion is used, the cam wedge 30 and the keeper wedges 50 may be used with window sashes closing from either side. The cam wedge 30 of FIG. 9 must however be turned according to the side the window will be opening, and the fasteners used therewith must allow the cam wedge 30 to be detached from the slider bar 24. Therefore, savings are involved in the manufacturing of only one type of cam wedge and one type of window that will serve on left or right sides of windows. However, the cam wedges 30 illustrated in FIGS. 11 and 12 may also be used in accordance with the present invention. The cam wedge 30 illustrated in FIG. 12 is universal as it positioned in the same manner whether it is on a right-side or left-side closing window and does not need to be turned during installation according to the side the window will be opening. However, it only provides half the travel or displacement the cam wedges 30 illustrated in FIGS. 9 and 11 provide. The cam wedge 30 of FIG. 11, on the other hand, may only be used on one side. Finally, although the slider bar 24 is shown translating up and down, it is obvious that the locking mechanism 20 may be set in the window frame 12 horizontally.

It is within the ambit of the present invention to cover any obvious modifications of the embodiments described herein, provided such modifications fall within the scope of the appended claims.

What is claimed is:

1. A cam wedge for a locking mechanism for locking a window sash in a closed position in a window frame, the locking mechanism being of the type having a slider portion translating longitudinally on a window frame in response to an actuation of a handle to engage at least two engagement members of the slider portion with corresponding keeper portions secured on the window sash for locking the window sash to the window frame, the cam wedge comprising a body having at least one flat ramped portion obliquely positioned with respect to a translation direction of the slider portion and a flat rest portion generally parallel to the translation direction of the slider portion, the cam wedge secured to the slider portion to be one of the at least two engagement members such that the at least one ramped portion slidingly engages with a corresponding keeper portion during a translation of the slider portion, and is guided by the corresponding keeper portion to abut the rest portion thereagainst to prevent a displacement of the window sash toward an open position thereof.

2. The cam wedge according to claim 1, wherein the cam wedge has at least two spaced connecting points with the slider portion.

3. The cam wedge according to claim 2, wherein one of the at least two spaced connecting points is a protrusion on the body of the cam wedge received in a hole in the slider portion.

4. The cam wedge according to claim 2, further comprising a lip projecting from the body, the lip being positioned so as to abut against a side edge of the slider portion in a direction opposed to an opening direction of the window sash to ensure the integrity of the locking.

5. The cam wedge according to claim 1, further comprising a second flat ramped portion such that the cam wedge can be used on any of a right-side closing window and a left-side closing window.

6. A multipoint locking mechanism for locking a window sash in a closed position in a window frame, the locking mechanism being of the type having a slider portion translating longitudinally in a window frame in response to an actuation of a handle to engage at least two engagement members of the slider portion with corresponding keeper portions in the window sash for locking the window sash to the window frame, wherein at least one of the at least two engagement members is a cam wedge having at least one flat ramped portion obliquely positioned with respect to a translation direction of the slider portion and a flat rest portion generally parallel to the translation direction of the slider portion, the cam wedge being positioned on the slider portion such that the at least one ramped portion slidingly engages with the corresponding keeper portion during a translation of the slider portion, and is slidingly guided by the corresponding keeper portion to abut the rest portion thereagainst to prevent a displacement of the window sash toward an open position thereof.

7. The multipoint locking mechanism according to claim 6, wherein the keeper portion engaging with the cam wedge is a keeper wedge having a ramped portion and a rest portion, the ramped portion of the cam wedge sliding against the ramped portion of the keeper wedge to abut the rest portion of the cam wedge against the rest portion of the keeper wedge in the locked position of the window sash to the window frame.

8. The multipoint locking mechanism according to claim 7, wherein the rest portions of the cam wedge and of the keeper wedge are generally perpendicular to a direction of opening of the window sash.

9. The multipoint locking mechanism according to claim 8, wherein the cam wedge and the keeper wedge each have a lip projecting outwardly from the rest portion thereof, the lips abutting one another so as to prevent lateral displacement therebetween.

10. The multipoint locking mechanism according to claim 6, wherein the cam wedge is secured in at least two spaced connecting points to the slider portion.

11. The multipoint locking mechanism according to claim 10, wherein one of the at least two spaced connecting points is a protrusion on the body of the cam wedge received in a hole in the slider portion.

12. The multipoint locking mechanism according to claim 10, wherein the cam wedge comprises a lip projecting from the body, the lip being positioned so as to abut against a Bide edge of the slider portion in a direction opposed to an opening direction of the window sash to ensure the integrity of the locking.

13. The multipoint locking mechanism according to claim 6, wherein the cam wedge comprises a second flat ramped portion such that the cam wedge can be used on any of a right-side closing window and a left-side closing window.

14. The multipoint locking mechanism according to claim 13, wherein the cam wedge has the first ramped portion and the second flat ramped portion disposed side by side thereon and meeting at a central apex such that the wedge can be used on any of a right-side closing window and a left-side closing window.

15. The multipoint locking mechanism according to claim 6, wherein the at least two engagement members are positioned with respect to one another on the slider portion such that one of the at least two engagement members engages the corresponding keeper portion before another of the at least engagement members so as to perform a gradual locking of the window sash to the window frame.

* * * * *